United States Patent [19]

Körber

[11] 4,100,845

[45] Jul. 18, 1978

[54] METHOD AND MACHINE FOR PRODUCING FILTER ELEMENTS FOR TOBACCO SMOKE

[75] Inventor: Kurt A. Körber, Hamburg, Fed. Rep. of Germany

[73] Assignee: Hauni-Werke Körber & Co. KG, Hamburg, Fed. Rep. of Germany

[21] Appl. No.: 680,722

[22] Filed: Apr. 27, 1976

[30] Foreign Application Priority Data

May 15, 1975 [LU] Luxembourg ..... 72749

[51] Int. Cl.[2] ..... A24C 5/50

[52] U.S. Cl. ..... 93/77 FT; 131/261 B

[58] Field of Search ..... 93/1 C, 77 FT, 1 WZ, 93/1 H; 131/10.5, 261 B

[56] References Cited

U.S. PATENT DOCUMENTS

| | | | |
|---|---|---|---|
| 2,499,463 | 3/1950 | Crary | 93/1 WZ X |
| 2,941,533 | 6/1960 | Crawford | 131/10.5 |
| 3,518,921 | 7/1970 | Müller | 93/1 C |
| 3,744,497 | 7/1973 | Marciuliano | 131/10.5 X |
| 3,933,160 | 1/1976 | Gerardy | 93/77 FT X |

FOREIGN PATENT DOCUMENTS

| | | | |
|---|---|---|---|
| 425,869 | 3/1935 | United Kingdom | 131/10.5 |

*Primary Examiner*—James F. Coan
*Attorney, Agent, or Firm*—Peter K. Kontler

[57] ABSTRACT

A filter element for use as a mouthpiece for filter cigarettes, cigarillos or cigars has an inner tubular wall with lugs which are bent inwardly from the material of the inner wall, and an outer tubular wall which seals the outer ends of openings which develop as a result of formation and bending of the lugs. The lugs and the two walls constitute a labyrinth for tobacco smoke, and the filtering action of the filter element can be enhanced by coating or impregnating the lugs and/or the inner wall with suitable chemicals which absorb or neutralize tar, nicotine and/or other deleterious ingredients of tobacco smoke. The filter element is made of a one-piece continuous paper web which is formed with lugs in a region adjacent to one of its marginal portions, which is thereupon folded over itself to form two layers, and which is thereupon converted into a continuous rod ready to be subdivided into filter elements of desired length. The outer wall of the rod has a longitudinally extending seam where one of its marginal portions overlaps and is bonded to the other marginal portion.

21 Claims, 8 Drawing Figures

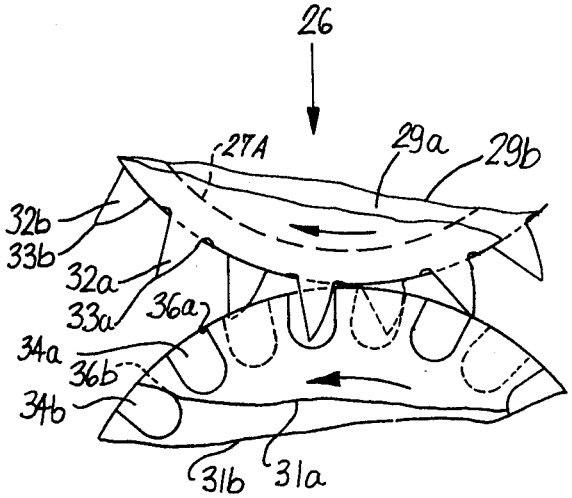
Fig.4
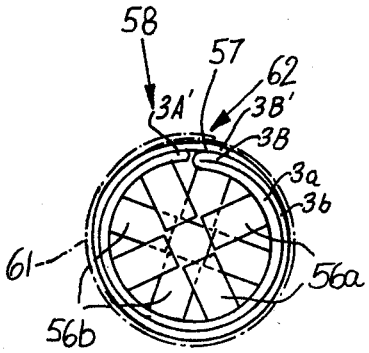
Fig.7
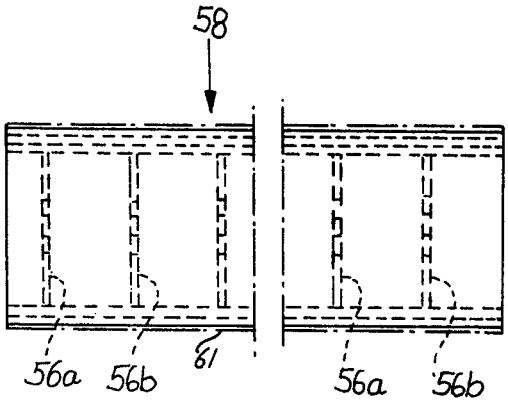
Fig.8
Fig.5
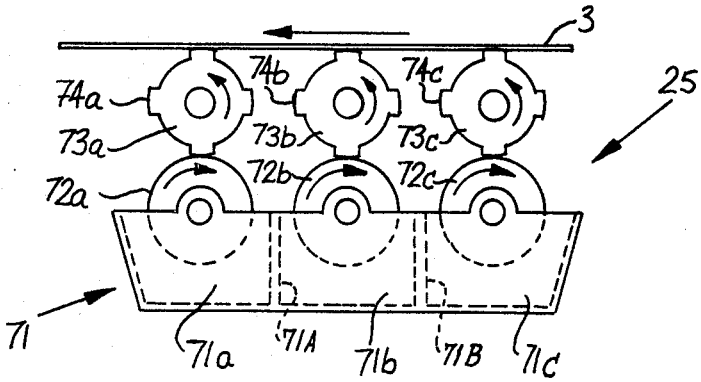

METHOD AND MACHINE FOR PRODUCING FILTER ELEMENTS FOR TOBACCO SMOKE

BACKGROUND OF THE INVENTION

The present invention relates to a method and machine for the production of filter elements which can constitute component parts of filter cigarettes, cigars or cigarillos.

It is known that a so-called labyrinth filter element constitutes a very effective means for intercepting deleterious ingredients of tobacco smoke. Nevertheless, such filter elements are not used in filter cigarettes, cigars or cigarillos because all heretofore known methods and machines for their manufacture are too expensive, too complex or too slow. The cost of presently known labyrinth filter elements is so high that they contriubute excessively to the cost of smokers' products, i.e., filter-tipped smokers' products containing presently known labyrinth filter elements could not compete with other types of filter-tipped smokers' products. This is due to the fact that the presently known methods are not suited for mass-production of labyrinth filter elements which consist of a relatively cheap starting material; the making of labyrinth filter elements from such material is tantamount to piecework. On the other hand, the cost of starting materials (primarily synthetic plastic substances) which are suited for the production of labyrinth filter elements at a reasonably high rate in accordance with presently known techniques is excessive.

SUMMARY OF THE INVENTION

An object of the invention is to provide a novel and improved method of producing labyrinth filter elements which can be used in filter cigarettes, cigars or cigarillos.

Another object of the invention is to provide a simple and economical method of mass-producing filter elements each of which constitutes a labyrinth to the passage of tobacco smoke therethrough.

A further object of the invention is to provide a method which can be practiced by resorting to simple machines and which can be used for mass-production of labyrinth filter elements capable of offering a predictable resistance to the flow of tobacco smoke therethrough as well as of intercepting deleterious ingredients of tobacco smoke not only owing to their design but also as a result of the composition or treatment of their constituents.

Still another object of the invention is to provide a simple, compact and relatively inexpensive machine which can be used for mass-production of improved labyrinth filter elements in accordance with the above-outlined method.

Another object of the invention is to provide a machine which can convert a paper web into a succession of labyrinth filter elements ready for introduction into a filter cigarette making or like machine.

An additional object of the invention is to provide a machine which can be readily adjusted to produce labyrinth filter elements which are capable of removing varying amounts of deleterious ingredients from tobacco smoke, and which can be designed to turn out labyrinth filter elements at a rate high enough to meet the requirements of at least one modern high-speed filter cigarette making or like machine.

One feature of the invention resides in the provision of a method of producing and processing a continuous filter rod. The method comprises the steps of continuously conveying a web of paper or other suitable flexible material from a roll or another source of supply lengthwise along a predetermined path, partially removing from the moving web a plurality of projections or lugs which continue to adhere to the web and flexing or deflecting the lugs to one side of the moving web, converting the web into a continuous multi-walled rod wherein an outer tubular wall surrounds an inner tubular wall and the lugs extend into the interior of the inner wall, and subdividing the rod into discrete rod-like filter elements or sections each of which contains a plurality of lugs, as considered in the axial and circumferential directions of the filter element, so that the lugs and the walls form a labyrinth for the flow of a gaseous fluid (particularly tobacco smoke) through the respective filter element.

The removing step preferably comprises providing the web with incisions surrounding openings which develop in the web as a result of the flexing or deflecting step. The openings are preferably provided only in the inner wall and are thus surrounded and sealed at the outside by the outer wall. The lugs preferably form several rows which extend lengthwise of the rod, and the neighboring lugs of at least two rows are preferably staggered with respect to each other, as considered in the axial direction of the rod. This enhances the smoke filtering action of the filter elements. The lugs (or at least the majority of lugs) are preferably polygonal. For the sake of simplicity, the lugs preferably resemble narrow rectangles so that each lug forms a narrow strip which extends deep into the interior of the inner wall of the rod. It has been found that such configuration of the lugs also enhances the filtering effect of the filter elements.

The method preferably further comprises the step of applying to at least some lugs, to all of the lugs, or to at least some of the lugs and to at least some portions of the inner wall, at least one substance which absorbs or neutralizes deleterious ingredients of tobacco smoke. Such substance or substances may form layers at one side of each lug or at the inner side of the inner wall. Alternatively, the inner wall and/or the lugs may be impregnated with such substance or substances.

In accordance with a presently preferred embodiment, the width of the web at least equals but preferably exceeds two circumferences of the rod, and the method then preferably further comprises the step of weakening the web along a line extending intermediate the marginal portions of the web so that the line is disposed between first and second panels which are respectively adjacent to the one and the other marginal portion of the web. The removing step then preferably comprises forming the lugs in the first panel and the converting step then comprises folding the second panel over the first panel and thereupon converting the thus obtained twin-panelled (narrower) web into the aforementioned rod. The first panel constitutes the inner wall of the rod and the second panel constitutes the outer wall, i.e., the second panel is a tubular envelope which surrounds the inner wall and seals the openings which are obtained in response to deflection of lugs from the general plane of the first panel of the web. The weakening step preferably includes forming the web with a line of perforations or slits.

The width of the second panel preferably exceeds the width of the first panel so that the other marginal portion of the web extends beyond the first panel upon completion of the folding step. The web is preferably deformed in opposite directions at both sides of the line of perforations prior to the converting step.

The other marginal portion of the web is preferably curled prior to the converting step, and the curled marginal portion (which forms part of the second wall) is coated with a suitable adhesive which adheres to a second portion of the outer wall upon completion of the converting step so that the outer wall exhibits a seam extending lengthwise of the rod.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is an enlarged view of a second detail in FIG. 1;

FIG. 5 is an enlarged view of a third detail in FIG. 1;

FIG. 7 is an end elevational view of a labyrinth filter element and

FIG. 8 is a fragmentary side elevational view of the filter element of FIG. 7.

DESCRIPTION OF THE PREFERRED EMBODIMENTS

Figures 1, 2, 3, 6:
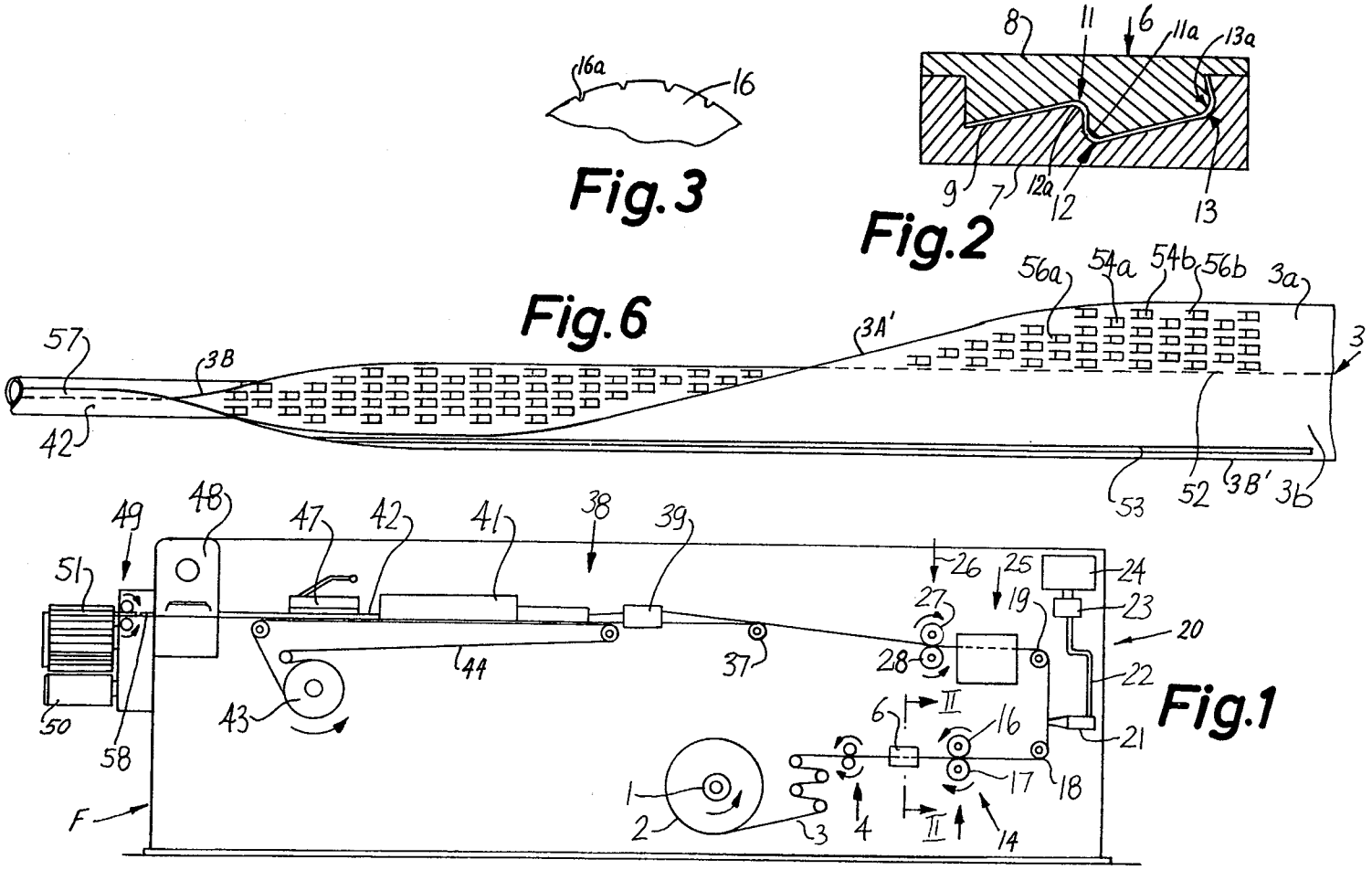
FIG. 1 is a schematic elevational view of a machine for the production of improved labyrinth filter elements.
FIG. 2 is an enlarged transverse vertical sectional view as seen in the direction of arrows from the line II—II of FIG. 1.
FIG. 3 is an enlarged view of a first detail in FIG. 1.
FIG. 6 is an enlarged fragmentary view of a flexible paper web, showing its conversion into a twin-walled filter rod.

The filter-rod making machine which is shown in FIG. 1 comprises a frame F which supports a spindle 1 for a source of supply 2 of convoluted filter material in the form of an elongated paper web 3. The width of the paper web 3 at least equals but preferably exceeds twice the circumference of the finished filter rod. The means for drawing the web 3 off the supply 2 comprises two advancing rolls 4 at least one of which is driven in the direction indicated by arrow and the other of which is biased toward the one roll.

The frame F further supports a crimping or flexing device 6 the details of which are shown in FIG. 2. This device comprises a first or lower section 7 and a second or upper section 8 which defines with the section 7 an elongated substantially S-shaped channel 9. The web 3 passes through the channel 9 in a direction at right angles to the plane of FIG. 2. The neighboring surfaces of the sections 7 and 8 are respectively formed with complementary ribs 12*a*, 11*a* and grooves 12, 11 which crimp or flex the median portion of the web 3. An additional rib 13*a* of the section 8 extends into a groove 13 of the section 7 to flex or bend one marginal portion of the web 3. These portions of the web 3 which travel along the ribs 11*a*, 12*a* are flexed in the opposite directions.

The thus deformed web 3 thereupon passes through a weakening device 14 which reduces the strength of the web between the portions which were flexed by the ribs 12*a*, 11*a* of the sections 7 and 8. In the illustrated embodiment, the weakening device 14 includes a rotary roller-shaped counterknife 16 which cooperates with a complementary rotary roller-shaped perforating knife 17 so as to provide the web with a line or row 52 of perforations or slits shown in FIG. 6. The rotary counterknife 16 (see FIG. 3) has a plurality of shallow recesses 16*a* which are machined into its periphery and receive complementary cutting edges of the rotary knife 17.

The web 3 thereupon passes around guide rollers 18 and 19 which are located at different levels and cause one side of a portion of the web to face in a direction to the right, as viewed in FIG. 1. Such portion of the web 3 travels along the orifice defined by the nozzle 21 of a paster 20 which further includes a tank 24 for a supply of adhesive, a pump 23 which draws adhesive from the tank, and a pipe 22 which connects the outlet of the pump 23 with the nozzle 21. The orifice of the nozzle 21 applies a narrow layer or film 53 of adhesive (see FIG. 3) to one marginal portion of the web 3.

The guide roller 19 is followed by an applicator 25 which coats selected portions of the web 3 with chemicals designed to absorb or neutalize certain deleterious ingredients of tobacco smoke. As shown in FIG. 5, the applicator 25 comprises a vessel 71 which is formed with partitions 71A, 71B to define three discrete compartments 71*a*, 71*b*, 71*c* each of which contains a different chemical. The means for transferring chemicals from the compartments 71*a*, 71*b*, 71*c* to the underside of the web 3 comprises three withdrawing rollers 72*a*, 72*b*, 72*c* which respectively dip into the supplies of chemicals in the compartments 71*a*, 71*b*, 71*c*, and transfer rollers 73*a*, 73*b*, 73*c* each of which has several projections or lobes 74*a*, 74*b*, 74*c*. The radially outermost surfaces of projections 74*a*, 74*b*, 74*c* respectively receive films of chemicals from the peripheral surfaces of withdrawing rollers 72*a*, 72*b*, 72*c* and transfer the films to the underside of the web 3 which advances in the direction indicated by arrow. Chemicals which can be used for application to the web 3 are disclosed, for example, in Brit. Pat. No. 1,256,808. It is clear that the applicator 25 can be modified so as to apply a single chemical, two different chemicals, or four or more different chemicals.

The rollers 73*a*, 73*b*, 73*c* can transfer onto the web 3 a single layer of chemicals wherein different types of chemicals alternate with each other. However, it is equally within the purview of the invention to stagger the rollers 73*a*, 73*b*, 73*c* in a direction at right angles to the plane of FIG. 5 so that the applicator 25 provides the underside of the web 3 with three discrete rows of small patches of respective chemicals. In the latter instance, the projections 74*a*, 74*b*, 74*c* of the rollers 73*a*, 73*b*, 73*c* can be omitted so that each of these rollers applies to the web a continuous layer of the respective chemical. It is presently preferred to construct and mount the rollers 73*a*, 73*b*, 73*c* in such a way that they coat or impregnate selected portions of the web 3 namely those portions which are thereupon moved out of the general plane of the web in order to form lugs 56*a*, 56*b* shown in FIGS. 6 to 8. The lugs 56*a*, 56*b* are formed by a combined incising and deflecting device 26 which is mounted downstream of the applicator 25 and certain details of which are illustrated in FIG. 4. If desired, a suitable heating device (not shown) can be installed between the applicator 25 and the device 26 to promote at least partial drying of the layers which are applied by the projections 74*a*, 74*b*, 74*c*.

The device 26 comprises two rotary drums 27 and 28. The drum 27 has a circumferentially extending recess or groove 27A so that the periphery of this drum does not contact the film 53 of adhesive which has been applied by the nozzle 21 of the paster 20. Each of the drums 27 and 28 is assembled of several coaxial disks (see the disks 29*a*, 29*b* and 31*a*, 31*b* in FIG. 4). The disks 29*a*, 29*b* have rows of projections or teeth 32*a*, 32*b* with cutting edges 33*a*, 33*b*. The disks 31*a*, 31*b* have rows of complementary recesses or sockets 34*a*, 34*b* bounded by cutting edges 36*a*, 36*b*. The disk 29*a* is angularly offset with respect to the disk 29*b* by a distance which is half the spacing between the centers of two neighboring teeth 32*b* or 33*b*. Analogously, the sockets 34*a* of the disk 31*a* are angularly offset with respect to the sockets 34*b* of the disk 31*b* by a distance which equals half the spacing between the centers of two neighboring sockets 34*a* or 34*b*.

The web 3 thereupon advances along a folding roller 37 which folds the intact panel 3*b* (FIG. 6) of the web over the apertured panel 3*a* whereby the lugs 56*a*, 56*b* extend away from the panel 3*b*. The roller 37 reduces the width of the web to approximately one-half the original width. The web 3 thereupon enters a draping or wrapping mechanism 38 which converts it into a continuous multi-walled filter rod 42. The mechanism 38 comprises a curving or shaping device 39 which converts the web into a trough-shaped body before the thus deformed web enters the main portion 41 of the mechanism 38. The continuous filter rod 42 which issues from the main portion 41 has a cross-sectional outline shown in FIG. 7 by solid lines. The film 53 of adhesive adheres to a marginal portion 3B′ of the panel 3*b* in the region of the row of perforations 52 so as to form with the other marginal portion 3B of the panel 3*b* a longitudinally extending seam 57 (FIG. 6) which is heated by a suitable sealer 47 serving to promote rapid setting of the adhesive. The means for transporting the web 3 through the wrapping mechanism 38 comprises an endless conveyor belt 44 (known as garniture) which is trained around several rolls including a driver roll 43.

The web 42 thereupon enters a suitable severing mechanism 48 which may be of the type known as a cutoff and customarily employed in cigarette making machines. The cutoff 48 subdivides the web 42 into a single file of discrete filter elements or sections 58 which are thereupon accelerated by one or more rapidly rotating cams 49 to propel successive filter elements 58 into successive flutes of a rotary drum-shaped row forming conveyor 51. The conveyor 51 converts the single file of filter elements 58 into two or more rows wherein the filter elements travel sideways and are deposited on the upper reach of a take-off conveyor belt 50. The conveyor belt 50 transports the filter elements 58 to storage or directly to the magazine of a filter cigarette, cigar, or cigarillo making machine, not shown.

Referring to FIG. 6, it will be seen that the openings 54*a*, 54*b* are formed only in the narrower panel 3*a* of the web 3, i.e., at one side of the line 52 of perforations and that the other panel 3*b* of the web remains intact. The film 53 of adhesive is adjacent to the free marginal portion 3B′ of the panel 3*b*. As mentioned before, the line 52 of perforations is formed by the weakening device 14 of FIG. 1. The width of the panel 3*b* at least slightly exceeds the width of the panel 3*a*. The openings or cutouts 54*a*, 54*b* are formed by the teeth 32*a*, 32*b* of the disks 29*a*, 29*b* shown in FIG. 4. The layers of chemicals which are applied by the rollers 73*a*, 73*b*, 73*c* of FIG. 5 have been omitted in FIG. 6 for the sake of clarity. The number of lugs 56*a*, 56*b* can greatly exceed the number which is shown in FIG. 6. In actual practice, the number of lugs 56*a*, 56*b* per filter element 58 can be very large, not only as considered in the axial but also in the circumferential direction of the filter element.

That portion of the web 3 where the panel 3*b* is folded over the panel 3*a* is shown without lugs 56*a*, 56*b* for the sake of clarity of illustration. As mentioned above, these lugs extend into the interior of the inner wall (deformed panel 3*a*) of the rod 42.

The operation of the machine of FIGS. 1–6 is as follows:

The advancing rolls 4 draw the web 3 continuously off the supply 2 and successive increments of the web pass through the crimping or flexing device 6. The web is deformed along one of its marginal portions, namely, along the marginal portion 3B′ of the panel 3*b*, and intermediate the marginal portions 3A′, 3B′ at both sides of the line 52 where the weakening device 14 provides the web with a row of perforations. The web 3 thereupon passes through the weakening device 14 which provides it with the line 52 of perforations and the free marginal portion 3B′ of the panel 3*b* is thereupon coated with the layer 53 of adhesive during travel past the orifice of the nozzle 21. The web 3 thereupon passes through the applicator 25 which provides it with several rows of liquid chemicals in a manner as described in connection with FIG. 5. In the next-following step, the web 3 passes through the device 26 which provides the panel 3*a* with incisions surrounding the openings 54*a*, 54*b* and lugs 56*a*, 56*b*. The openings 54*a*, 54*b* are but need not be rectangular. The teeth 32*a*, 32*b* of the disks 29*a*, 29*b* bend the lugs 56*a*, 56*b* to one side of the general plane of the panel 3*a*. As shown in FIG. 7, each filter element 58 which is obtained on subdivision of the rod 42 contains a large number of lugs 56*a*, 56*b* which extend longitudinally as well as transversely or circumferentially of the filter element.

The web 3 thereupon travels along the folding roller 37 which folds the panel 3*b* over the panel 3*a*. In the next step, the web passes through the portions 39 and 41 of the wrapping mechanism 38 so that it is converted into a continuous rod 42 having a seam 57 which is heated by the sealer 47. The rod 42 is thereupon severed by the cutoff 48 so as to yield a file of filter elements 58 which are transferred into the flutes of the row forming conveyor 51 by the accelerating cam or cams 49. The conveyor 51 transfers one or more rows of filter elements 58 onto the take-off conveyor belt 50.

If desired, one side of the web 3 can be provided with a carding of filaments, for example, in a manner as disclosed in U.S. Pat. No. 3,339,560 to Kiefer et al. The purpose of filaments is to further enhance the filtering action of the elements 58. The manner in which the filter elements 58 are thereupon subdivided into shorter sections and assembled with plain cigarettes, cigars or cigarillos forms no part of the present invention.

FIGS. 7 and 8 show a filter element 58 wherein the lugs 56*a*, 56*b* of the panel 3*a* and the two tubular walls (converted panels 3*a*, 3*b*) form a labyrinth through which the tobacco smoke must pass on its way from the lighted end of a cigarette, cigarillo or cigar toward the smoker's mouth. The lugs 56*a*, 56*b* are coated with chemicals which absorb or neutralize deleterious ingredients of tobacco smoke. Additional deleterious ingredients can be intercepted by the aforediscussed filaments which can be applied to the web 3 in a manner as disclosed in the patent to Kiefer et al. The phantom lines indicate that the filter element 58 can be wrapped into a layer of cigarette paper 61 which forms a third or outermost tubular wall of the filter element. The outermost wall is advantageous and desirable because it overlies the seam 57 of the filter element 58 to reduce the likelihood of uncontrolled escape of tobacco smoke or uncontrolled inflow of air. The seam 62 of the outermost wall may but need not be adjacent to the seam 57. The outermost wall preferably consists of cigarette paper so that the filter element resembles a plain cigarette, i.e., that it can form a mouthpiece which appears to form part of a plain cigarette.

For the sake of clarity, FIGS. 7 and 8 show a relatively small number of lugs 56*a* and 56*b*. The number of such lugs can be greatly increased so as to provide a more complex labyrinth which intercepts a larger amount of deleterious ingredients of tobacco smoke.

It is also within the purview of the invention to make the filter rod of several discrete webs, for example, by cutting a relatively wide strip lengthwise to form two discrete webs, by providing the lugs in one of the webs, by causing the other web to overlie the one web, and by thereupon converting the thus obtained twin-layered web into a rod wherein the lugs extend into the interior of the inner layer or wall. The just described modified method of making a multi-walled filter rod is more complex and more expensive than the method which can be practiced with the apparatus of FIGS. 1 to 6 because the machine for the practice of the modified method must embody accurately machined and mounted guide means for the strip and for the two webs, means for cutting the strip lengthwise, and means for shifting the other web sideways so that it overlies the one web, or vice versa. In accordance with the method which can be practiced with the machine of FIGS. 1 to 6, the starting material for the rod 42 is a single web 3 which need not be cut lengthwise and which can be converted into a multi-walled tubular body by the simple expedient of folding the panel 3*b* over the panel 3*a* or vice versa. The panel 3*a* is thereupon converted into the inner tubular wall and the panel 3*b* is simultaneously converted into the outer tubular wall of the rod 42 whereby the outer wall seals the openings 54*a*, 54*b* at the outside. The folding of panel 3*b* over the panel 3*a* or vice versa is simplified by the provision of device 14 which weakens the web 3 between the panels 3*a*, 3*b*, i.e., along the line 52, so that the folding of panels 3*a*, 3*b* over each other can be carried out with a high degree of accuracy and reproducibility. Weakening of the web along the line 52 is desirable and advantageous on the additional ground that the two integrally connected marginal portions 3A, 3B of the panels or walls 3*a*, 3*b* do not exhibit a tendency to move away from each other when the conversion of panels 3*a*, 3*b* into the rod 42 is completed. The marginal portion 3A of the panel 3*a* then faces the marginal portion 3A', and the marginal portion 3B' of the outer panel 3*b* overlies the marginal portions 3A, 3A' as well as the marginal portion 3B and forms with the latter a seam 57 which extends lengthwise of the rod 42, i.e., lengthwise of each filter element 58. The adhesive layer 53 bonds the marginal portion 3B' to the outer or exposed side of the marginal portion 3B.

Weakening of the web 3 along the line 52 between the panels 3*a*, 3*b* exhibits the additional advantage that the overlapping panels 3*a*, 3*b* can be readily converted into a rod 42 of circular or substantially circular shape. The rod 42 retains its circular shape which is highly desirable in order to facilitate the assembly of filter elements 58 (or of shorter sections of such filter elements) with cylindrical plain cigarettes, cigarillos or cigars.

The width of the panel 3*b* exceeds the width of the panel 3*a* to an extent which slightly exceeds the width of the marginal portion 3B'. The width of the narrower panel 3*a* equals or approximates the circumference of the rod 42. The flexing of web 3 (in the device 6 of FIG. 2) at both sides of the line 52 where the device 14 weakens the web 3 also reduces the tendency of the rod 42 to undergo deformation (out of round) after it issues from the wrapping mechanism 38. The flexing or bending of marginal portion 3B' (at 13, 13*a* in FIG. 2) promotes the tendency of this marginal portion to adhere to the marginal portion 3B, i.e., the seam 57 is less likely to open during further processing of the rod 42, especially during severing by the cutoff 48 and subsequent propulsion of filter elements 58 into the flutes of the row forming conveyor 51.

The filter elements can be used with particular advantage for the making of cigarettes known as papyrossi.

Referring again to FIG. 5, the compartment 71*a* of the vessel 71 can store a supply of an organic acid (e.g., tartaric acid) which, when applied to the web 3, intercepts nicotine. The compartment 71*b* can store a supply of triacetin for interception of phenols. The compartment 71*c* can contain a supply of sodium carbonate for interception of prussic acid. The above are but a few examples of substances which can be applied to the web 3, especially to the lugs 56*a*, 56*b*, to intercept and/or neutralize deleterious ingredients of tobacco smoke.

An important advantage of the filter element 58 is that it can be produced in a relatively simple machine and in a manner somewhat similar to that which has been found to be advantageous for continuous mass-production of plain cigarettes or conventional filter elements which contain tows of crimped filamentary filter material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. A method of producing and processing a continuous filter rod, comprising the steps of conveying a continuous web of flexible material, particularly paper, lengthwise along a predetermined path; partially removing from the moving web a plurality of lugs which continue to adhere to the web and deflecting the lugs to one side of the web, said removing step comprising providing the web with incisions surrounding openings which develop in the web as a result of said deflecting step; converting the web into a continuous multi-walled rod wherein an outer tubular wall surrounds an inner tubular wall and said lugs extend into the interior of said inner wall, said openings being provided in said inner wall and being surrounded by said outer wall; and subdividing said rod into discrete rod-like filter elements each of which contains a plurality of lugs, as considered in the axial and circumferential directions of the filter element, so that said lugs and said walls form a labyrinth for the flow of a gaseous fluid through the respective filter element.

2. A method as defined in claim 1, further comprising the step of applying to at least some of said lugs a substance which absorbs or neutralizes deleterious ingredients of tobacco smoke.

3. A method as defined in claim 1, wherein said lugs form several rows extending lengthwise of said rod.

4. A method as defined in claim 1, wherein at least some neighboring lugs of said rod are staggered with respect to each other, as considered in the axial direction of said walls.

5. A method as defined in claim 1, wherein at least the majority of said lugs have a polygonal outline.

6. A method of producing and processing a continuous filter rod, comprising the steps of conveying a continuous web of flexible material, particularly paper, lengthwise along a predetermined path, the width of said web being at least equal twice the circumference of the filter rod; weakening the web along a line extending intermediate the marginal portions thereof so that said line is disposed between first and second panels which are respectively adjacent to the one and the other of said marginal portions; partially removing from the moving web a plurality of lugs which continue to adhere to the web and deflecting the lugs to one side of the web, said removing step including forming said lugs in said first panel; converting the web into a continuous multiwalled rod wherein an outer tubular wall surrounds an inner tubular wall and said lugs extend into the interior of said inner wall, said converting step comprising folding said second panel over said first panel and thereupon converting the thus obtained twin-paneled web of reduced width into said rod, said first panel constituting said inner wall of said rod; and subdividing said rod into discrete rod-like filter elements each of which contains a plurality of lugs, as considered in the axial and circumferential directions of the filter element, so that said lugs and said walls form a labyrinth for the flow of a gaseous fluid through the respective filter element.

7. A method as defined in claim 6, further comprising the step of curling said other marginal portion prior to said converting step and coating said other marginal portion with adhesive which adheres to said outer wall in the region of said line upon completion of said converting step to form a seam extending lengthwise of said rod.

8. A method as defined in claim 6, wherein said weakening step comprises forming the web with a line of perforations.

9. A method as defined in claim 6, wherein the width of said second panel exceeds the width of said first panel so that said other marginal portion of the web extends beyond said first panel upon completion of said folding step.

10. A method as defined in claim 6, further comprising the step of deforming said web in opposite directions at both sides of said line prior to said converting step.

11. In a machine for the production and processing of a continuous filter rod, a combination comprising a source of a continuous web of flexible material; means for moving the web from said source lengthwise along a predetermined path; means for partially removing from the moving web a plurality of lugs which continue to adhere to the web and for deflecting said lugs to one side of the web; means for converting the web into a continuous multi-walled rod wherein an outer tubular wall surrounds an inner tubular wall and said lugs extend into the interior of said inner wall; and means for subdividing said rod into discrete rod-like filter elements each of which contains a plurality of lugs, as considered in the axial and circumferential directions of the filter element so that such lugs and said walls form a labyrinth for the flow of a gaseous fluid through the respective filter element.

12. A combination as defined in claim 11, further comprising means for bending one marginal portion of the web.

13. A combination as defined in claim 11, wherein said removing and deflecting means comprises at least one rotary member having means for providing the moving web with incisions which form several rows extending lengthwise of the web and surround the respective lugs, and for moving the thus formed lugs to said one side of the moving web.

14. A combination as defined in claim 13, wherein said incision forming means is arranged to stagger the incisions of neighboring rows, as considered in the longitudinal direction of the web.

15. A combination as defined in claim 13, wherein said incision forming means has cutting edges which impart to said lugs a polygonal outline.

16. A combination as defined in claim 11, further comprising means for applying to said one side of the web at least one substance which absorbs or neutralizes at least some deleterious ingredients of tobacco smoke.

17. A combination as defined in claim 11, wherein the width of said web at least equals twice the circumference of said rod, and further comprising means for weakening the web along a line extending intermediate the marginal portions thereof so that the web includes a first panel at one side of said line and a second panel at the other side of said line, said converting means comprising means for folding the web along said line so that said second panel overlies said first panel, said converting means further comprising a device for respectively converting said first and second panels into the inner and outer walls of said rod.

18. A combination as defined in claim 17, wherein said weakening means comprises a device for perforating the web along said line.

19. A combination as defined in claim 17, wherein the width of said web exceeds twice the circumference of said rod.

20. A combination as defined in claim 19, wherein said line is located nearer to one than to the other marginal portion of the web and the width of said first panel at least approximates the circumference of said rod.

21. A combination as defined in claim 17, further comprising means for flexing the web in opposite directions in the region of said line.

* * * * *